US006250266B1

(12) United States Patent
Okui et al.

(10) Patent No.: US 6,250,266 B1
(45) Date of Patent: Jun. 26, 2001

(54) VARIABLE VALVE TIMING MECHANISM FOR ENGINE

(75) Inventors: Kaoru Okui; Masahiro Uchida, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/471,887

(22) Filed: Dec. 23, 1999

(30) Foreign Application Priority Data

Dec. 25, 1998 (JP) ..... 10-371487

(51) Int. Cl.[7] ..... F01L 1/34

(52) U.S. Cl. ..... 123/90.17; 123/90.15; 123/90.31

(58) Field of Search ..... 123/90.15, 90.16, 123/90.17, 90.18, 90.31

(56) References Cited

U.S. PATENT DOCUMENTS

| | | | | |
|---|---|---|---|---|
| 5,184,581 | * | 2/1993 | Aoyama et al. | 123/90.31 |
| 5,233,948 | * | 8/1993 | Boggs et al. | 123/64 |
| 5,531,193 | * | 7/1996 | Nakamura | 123/90.15 |
| 5,769,044 | * | 6/1998 | Moriya | 123/90.17 |
| 6,135,077 | * | 10/2000 | Moriya et al. | 123/90.17 |

* cited by examiner

*Primary Examiner*—Weilun Lo
(74) *Attorney, Agent, or Firm*—Ernest A. Beutler

(57) ABSTRACT

Several embodiments of variable valve timing mechanisms for an internal combustion engine wherein the timing of two valves associated with the same combustion chamber of the engine may be driven at the same time interval and at the same speed from the engine output shaft and both valves may have their timing adjusted simultaneously by a first variable valve timing mechanism and only one of the valves may have its timing adjusted relative to the other valve by a second variable valve timing mechanism to provide a simpler operational control and lower cost assembly.

6 Claims, 7 Drawing Sheets

VARIABLE VALVE TIMING MECHANISM FOR ENGINE

BACKGROUND OF THE INVENTION

This invention relates to an internal combustion engine and more particularly to a variable valve timing mechanism for operating the valves of such an engine.

It is well known that one of the factors that controls the performance of a four cycle, internal combustion engine is the valve timing mechanism. Generally, the valves are operated by one or more camshafts at a timed relationship to the rotation of the engine output shaft. Frequently, the intake valves are operated by a different camshaft than the camshaft which operates the exhaust valves. Such engines are called "double overhead cam engines",(DOHC).

Generally, the optimal valve timing for an engine varies, depending upon the speed and load at which the engine is operating. Thus, conventional engines having fixed valve timing arrangement generally are designed to provide a comprise between good running at low speeds and low loads and maximum engine output. Depending upon the use of the engine, the bias may be toward one or the other end of these two alternative ranges.

In order to improve performance over a wider range of engine speed and load conditions, it has been proposed to employ a variable valve timing arrangement in the drive for the camshafts. In this way, the timing relationship of the camshafts can be adjusted so as to provide optimal performance for more running condition.

The variable valve timing mechanisms which have been proposed generally fall into two categories. With the first of these and the simpler arrangement, the timing of both camshafts is generally altered in the same direction and at the same degree. This is done by interposing one variable valve timing mechanism in the timing drive between the engine output shaft and the camshafts. This has the advantages of simplicity, lower cost and still provides greater flexibility in engine performance.

The other type of system includes a pair of variable valve timing mechanisms each of which is interposed between the drive for the respective of the camshafts from the engine output shaft. This obviously doubles the number of components, including the control mechanism. It does, however, offer the possibility of a greater flexibility in overall engine performance.

It has been discovered, however, that there are a number of running conditions where the performance is optimal if both camshafts are adjusted at the same phase angle. Other running conditions have been found to require a different adjustment in the timing between the camshafts. Although this can be employed easily in an arrangement wherein there are independent variable valve timing mechanisms associated with each camshaft, this makes the control strategy more complicated.

It is, therefore, a principal object of this invention to provide an improved variable valve timing mechanism for an engine wherein two camshafts may have their timing altered simultaneously or independently of each other, depending upon the running characteristics.

It is a further object of this invention to provide an improved camshaft variable valve timing mechanism wherein simultaneous adjustment of both camshafts can be accomplished through the use of one variable valve timing mechanism and adjustment of the timing of the camshafts relative to each other is done by a separate variable valve timing mechanism.

SUMMARY OF THE INVENTION

This invention is adapted to be embodied in an internal combustion engine and camshaft timing drive therefore. The engine comprises an output shaft that is driven by combustion occurring in at least one combustion chamber of the engine. A first camshaft operates at least one valve associated with the combustion chamber. A second camshaft operates at least a second valve also associated with the one combustion chamber. First and second timing drives are provided for driving the camshafts at the same speed from the output shaft. A first variable valve timing arrangement is provided for adjusting the timing of both of the camshafts simultaneously and in the same degree and in the same direction relative to the rotation of the engine output shaft. A second variable valve timing mechanism is interposed in the timing drive for varying the timing between the two camshafts.

In accordance with the preferred embodiments of the invention that are illustrated, the first and second camshafts each operate either intake or exhaust valves. Although such an arrangement is possible, it also may be desirable to operate the valves of a multiple valve engine so that the timing of valves that serve the same function (either intake valves or exhaust valves), can have their timing adjusted either simultaneously or independently of each other.

Thus, although the illustrated embodiments show an arrangement wherein the intake and exhaust valves are timed separately, the invention also may be practiced with engines where valves that serve the same function (either intake or exhaust or both) can be operated simultaneously or independently. The structure for accomplishing this should be readily apparent from the description of the preferred embodiments which are illustrated.

DETAILED DESCRIPTION OF THE PREFERRED EMBODIMENTS OF THE INVENTION

Figure 1:
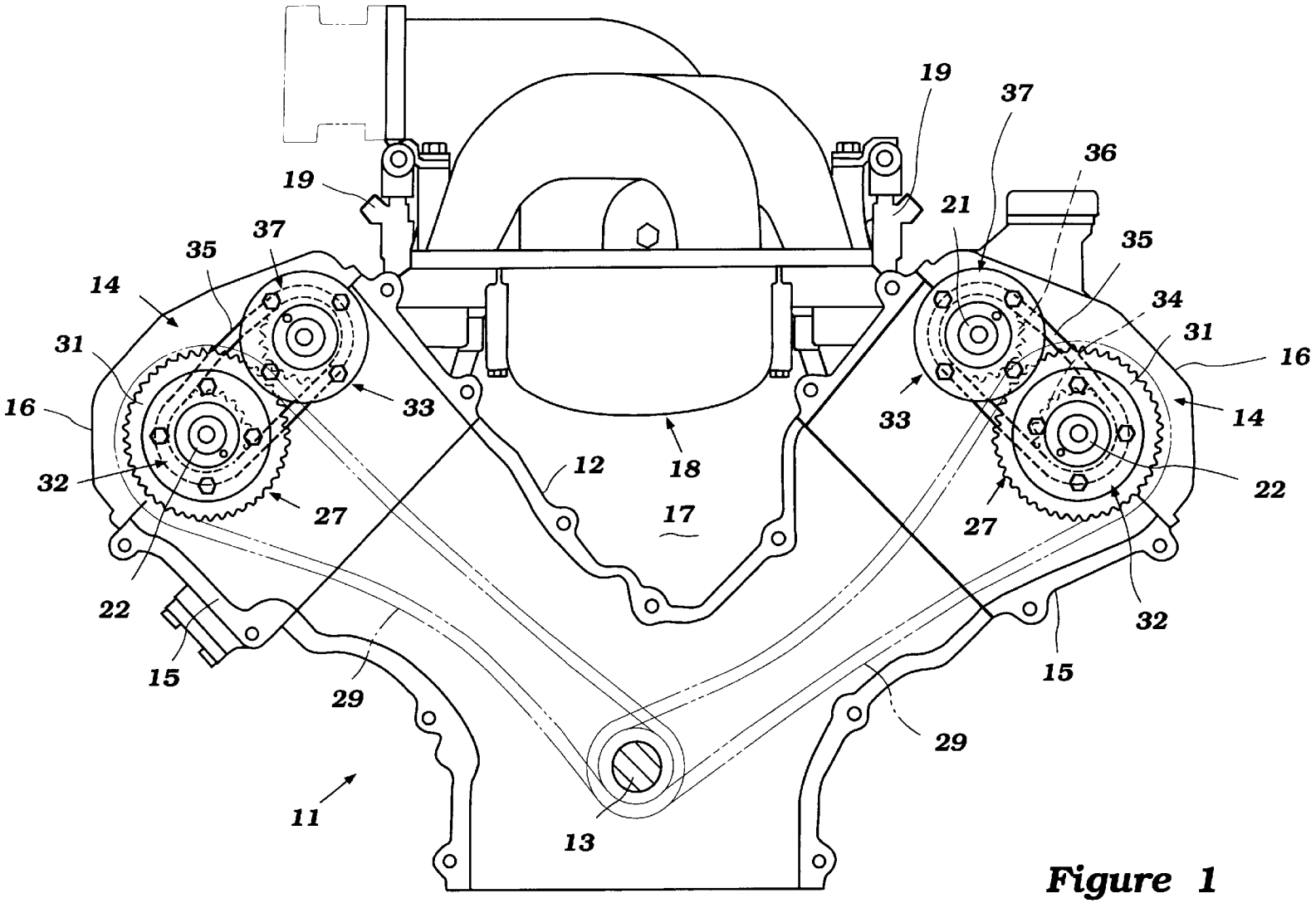
FIG. 1 is an end elevational view of a V-type internal combustion engine constructed in accordance with a first embodiment of the invention. In this figure, the camshaft driving mechanisms except for the flexible transmitters are shown in solid lines, while the basic engine construction is shown in phantom.
Figure 2:
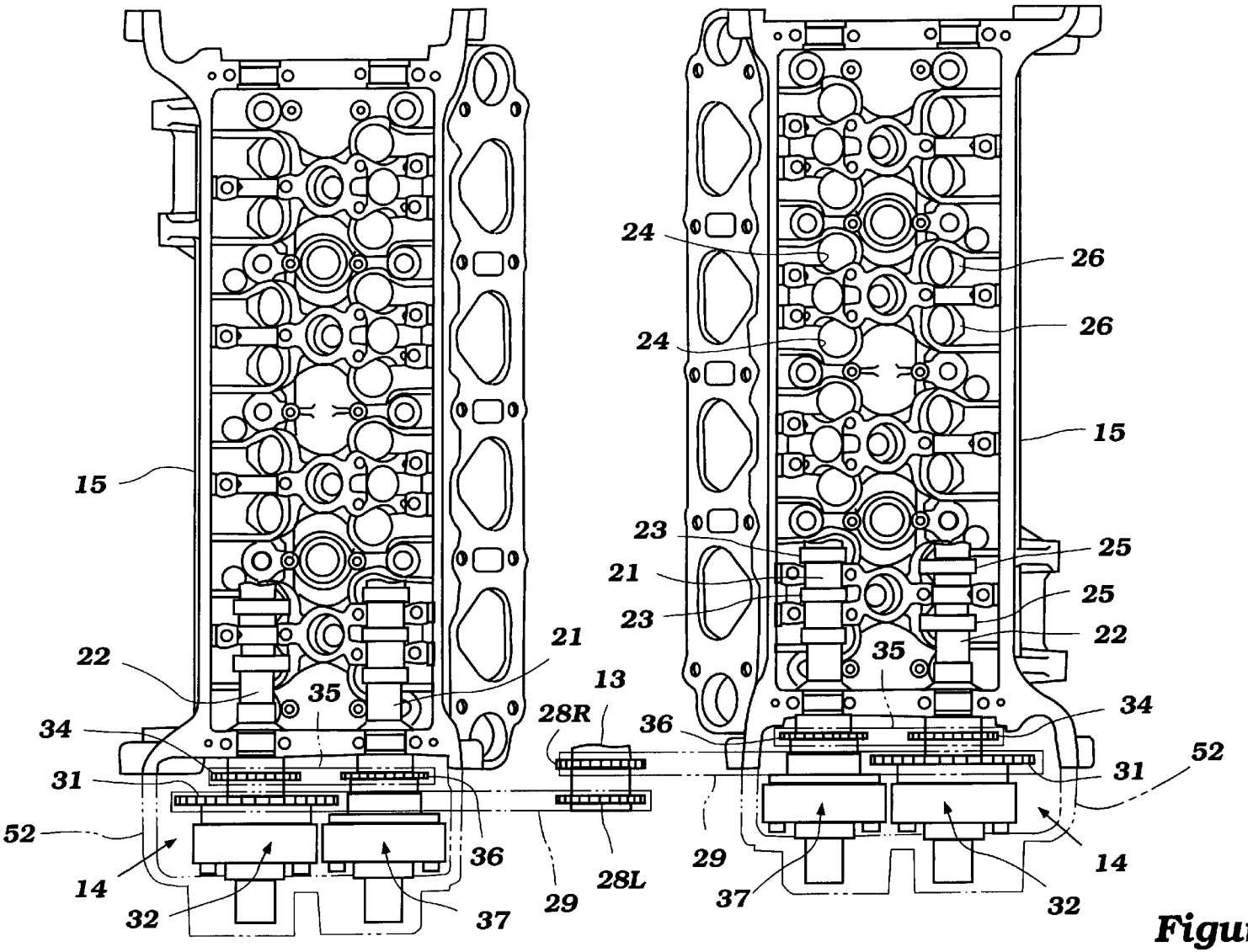
FIG. 2 is a top plan view of the engine shown in FIG. 1, illustrating the cylinder head in solid lines and the camshaft driving mechanism also in solid lines with other components of the engine shown in phantom. Also with certain components of the cylinder head assembly are removed so as to more clearly show the variable valve timing mechanism drive.
Figure 3:
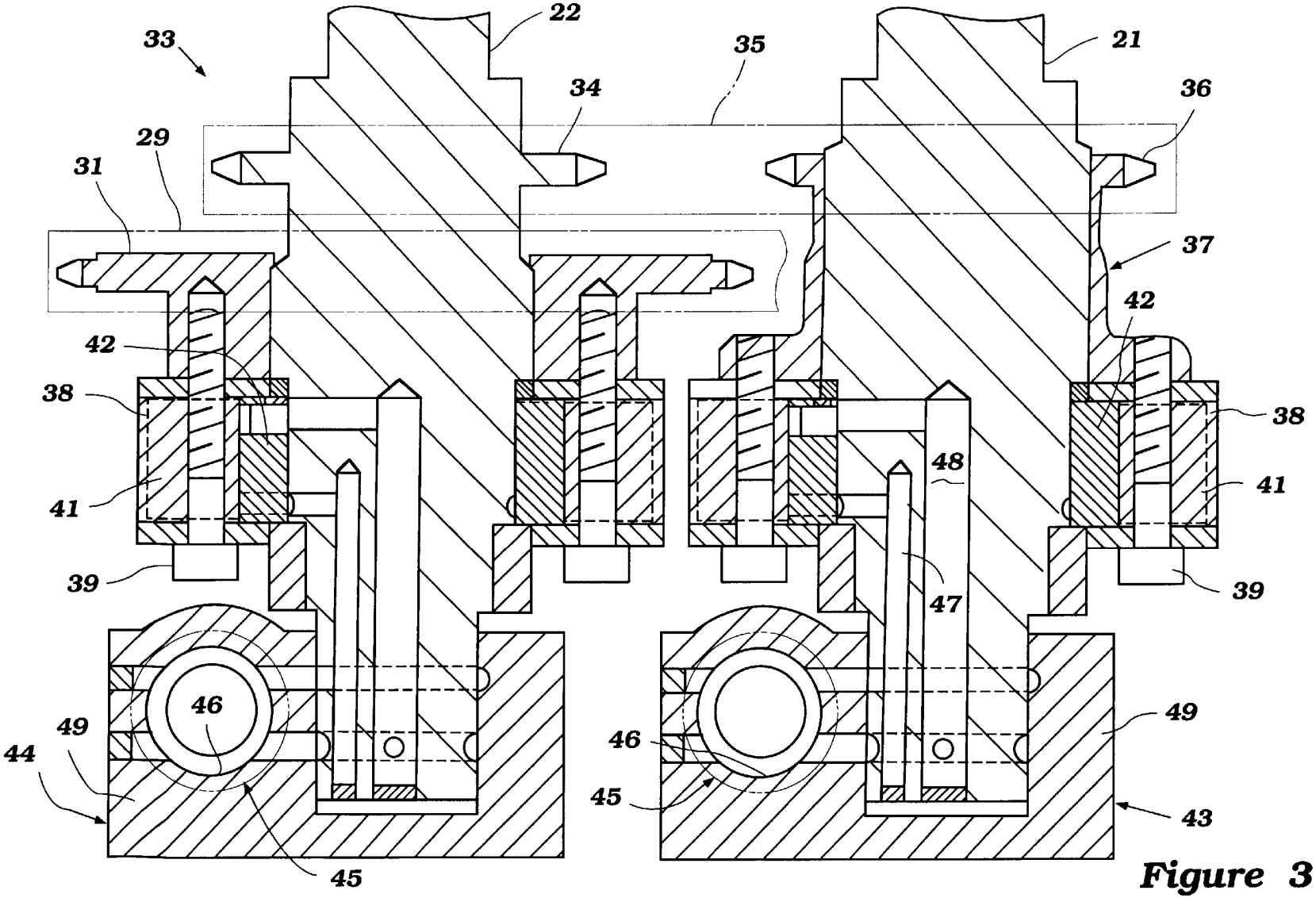
FIG. 3 is an enlarged cross-sectional view taken through one of the cylinder head assemblies shown in FIG. 2 and shows in more detail the arrangement of the variable valve timing mechanism of this embodiment.

Embodiment of FIGS. 1–3

An internal combustion engine constructed in accordance with a first embodiment of the invention is shown in these figures and is identified generally by the reference numeral 11. The engine 11 is, in this embodiment, illustrated as being of the V8 type. Although such an engine configuration and such a number of cylinders is illustrated, it will be readily apparent to those skilled in the art how the invention can be practiced with engines having other cylinder numbers and other cylinder configurations.

The engine 11 is comprised of a cylinder block assembly, which is shown only in phantom and which is identified by the reference numeral 12. This cylinder block assembly 12 has a pair of angularly disposed cylinder banks, each of which forms four aligned cylinder bores. In accordance with conventional practice, the cylinder bores of the respective banks may be staggered relative to each other so that there crankshafts may be journaled on common throws of a crankshaft 13 which is journaled for rotation in a suitable manner in the crankcase assembly of the cylinder block 12.

Since the internal construction of the cylinder bores may be of any known type, and since the invention can be utilized with a wide variety of types of engines, this construction is not illustrated. Those skilled in the art will readily understand how to use the invention with a wide variety of types of engine constructions.

Cylinder head assemblies 14 are fixed in a suitable manner to each of the banks of the cylinder blocks 12 and close the upper ends of the cylinder bores therein. Again, the actual formation of the combustion chambers and the valve arrangement associated therewith may be of any known type, although a specific example will be described shortly. Each cylinder head assembly 14 includes a main cylinder head member 15 and a cam cover 16 that is detachably connected thereto and which confines the valve operating mechanism, which will be described shortly by reference to FIG. 2.

The engine is arranged so that the sides of the cylinder head assemblies 14 that face a valley 17 formed between the cylinder banks comprise the intake side of the cylinder head assemblies 14. An intake manifold assembly 18 is provided for delivering at least an air charge to the combustion chambers of the respective cylinder banks through any desired type of intake porting formed in the cylinder head members 15.

A suitable charge forming system, such as one including manifold type fuel injectors 19, is associated with the induction system for supplying fuel to the combustion chambers. Although manifold injection is illustrated, it should be readily apparent to those skilled in the art that the invention can be utilized with direct cylinder injection or with carburetion, depending upon the desired construction of the engine.

Referring now primarily to FIG. 2, each cylinder head assembly 14 has an intake camshaft 21 and an exhaust camshaft 22 journaled primarily in the cylinder head members 15. As may be seen in this figure, each cylinder of the engine is of the four valve type embodying a pair of intake valves which are not shown, but which are operated from the intake camshaft 21 via lobes 23 formed thereon. The lobes 23 cooperate with thimble tappets that are slidably supported in bores 24 formed in the cylinder head member 15. These thimble tappets are associated with the intake valves to effect their operation in a well known manner.

In a like manner, the exhaust camshaft 22 has cam lobes 25 that are associated with thimble tappets which are not shown. These thimble tappets are slidably supported within bores 26 formed in the cylinder head member 15 for operating the exhaust valves.

Although the invention is described with a four valve per cylinder arrangement, it should be readily apparent to those skilled in the art how the invention can be employed with engines having other numbers of valves per cylinder.

In accordance with the invention, a timing drive arrangement is provided for driving the intake and exhaust camshafts 21 and 22 from the crankshaft 13 at one half crankshaft speed. In addition, an arrangement is provided so as to either permit simultaneous adjustment of the timing of both the intake and exhaust camshafts 21 and 22 at the same time and in the same direction relative to the crankshaft 13 or adjustment of the timing of these camshafts 21 and 22 relative to each other. This timing drive will now be described by primary reference initially to FIGS. 1–3. The control strategy for this embodiment and the embodiment of FIG. 6 will be described later by reference to FIGS. 4 and 5 and FIGS. 7–10.

The timing drive includes a first timing drive assembly, indicated generally by the reference numeral 27 which, in effect, drives the exhaust camshafts 22 of each cylinder bank from the crankshaft 13. There is a separate drive 27 for the exhaust camshaft 22 of each bank from the crankshaft 13. As a result, the crankshaft 13 has a pair of sprockets 28R and 28L which drive each of the camshafts 22. Since these drives are basically the same, their components have been identified by the same reference numeral.

These drives 27 include a first timing chain or other flexible transmitter 29 which is engaged with the respective crankshaft sprocket 28. These flexible transmitters 29 are engaged with sprockets 31 of a variable valve timing assembly, shown in detail in FIG. 3, which shows the left hand bank, and which is identified generally by the reference numeral 32. This drive will be described in more detail later, but nevertheless permits a shifting in the phase angle between the crankshaft 13 and the exhaust camshaft 22.

A second timing drive, indicated generally by the reference numeral 33, is provided for driving the intake camshaft 21 from the exhaust camshaft 22. This timing drive 33 includes a sprocket 34 which is fixed for rotation with the exhaust camshaft 22. The sprocket 33 drives a flexible transmitter, such as a chain 35. This chain 35 drives a second or driven sprocket 36 which forms an input member to a variable valve timing mechanism 37 which drives the intake camshaft 21.

The variable valve timing mechanism 37 permits adjustment in the phase angle between the sprocket 36 and the intake camshaft 21. The variable valve timing mechanisms 32 and 37 are basically the same in construction and hence only one of them will be described by reference to FIG. 3.

Each of the variable valve timing mechanisms 32 and 37 is of the rotating vane type and includes a driving member 38 which is fixed for rotation with the respective member driven from the crankshaft. In the case of the intake camshaft 21, this comprises the sprocket 36. In the case of the exhaust camshaft, this comprises the sprocket 31. Threaded fasteners 39 secure these members together to provide a non-rotational connection.

Contained within the members 38 within a fluid chamber therein is an actuating vane element 41 which has a connection to an inner sleeve 42 that is fixed for rotation with respective intake or exhaust camshafts 21 and 22, respectively. Upon the application of fluid pressure to a respective part of the chamber in which the actuating vanes 41 are contained, there will be a shift in rotational phase between the driving member 38 and the driven member 42 and respective camshaft 21 or 22.

This phase rotational change is accomplished under the control of a pair of control bodies 43 and 44 associated with the intake and exhaust camshafts 21 and 22, respectively. Again, each control body has the same general construction and is comprised of a respective actuating valve member 45 that is reciprocally supported in a bore 46 formed in the respective control body 43 and 44. The valve members 45 selectively pressurize or relieve fluid in the chamber in which the actuating vanes 41 are received through either pressure conduits 47 or return conduits 48 which are drilled into the ends of the intake and exhaust camshafts 21 and 22, respectively, and which communicate with corresponding passages formed in the driven members 42 to achieve this relative rotation. The type of VVT mechanism actually employed can be of any suitable type.

The control members 43 and 44 have external housings 49 which, along with the variable valve timing mechanisms 32 and 37, respectively, are received in a timing chamber formed in part by timing covers 51 (FIG. 2) that are affixed to the front ends of the cylinder head assembly 15. Hydraulic pressure for operating the VVT mechanisms 43 and 44 is derived from the lubricating system for the engine in any suitable manner.

Control Strategy

Figure 4:
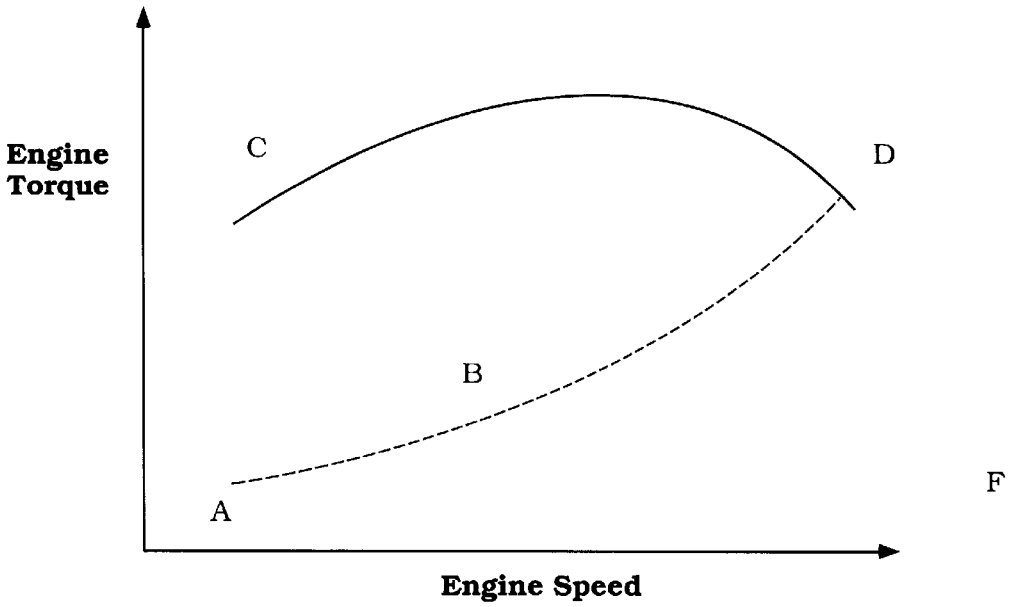
FIG. 4 is a graphical view torque engine speed diagram illustrating the control range strategies employed.
Figure 5:
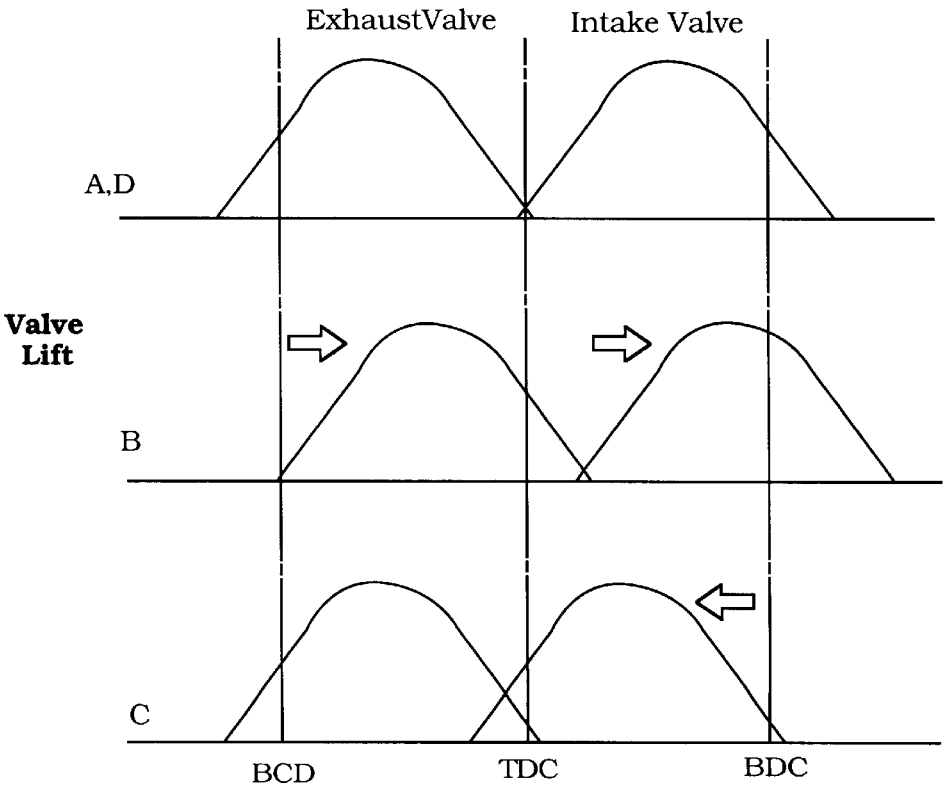
FIG. 5 is a graphical view showing the valve lift in accordance with the control ranges of FIG. 4 indicating from top to bottom, the condition (1) when both intake and exhaust valves are operated with conventional timing and conventional lift (Control ranges A and D), (2) when the timing phase of both valves are adjusted simultaneously and in the same direction and same amount (Control range B), and (3) when the timing of one of the valves is adjusted independently of the other (Control range C).

FIGS. 4 and 5 illustrate the control strategy and the various control phases under which engine performance is improved throughout the engine speed at load ranges in accordance with the invention. Referring first to FIG. 5, the upper view labeled A, D shows the valve timing which is generally conventional and which is utilized with many types of automotive applications. With this type of arrangement, the exhaust valve opens before bottom dead center (BDC) and continues to be opened fully occurring some time after BDC and then begins to close as the piston approaches top dead center (TDC) being fully closed slightly after the piston reaches TDC.

In a similar manner, the intake valve opens at approximately top dead center and continues to open until some point about half way between top and bottom dead center and then begins to close with full closure occurring some time after bottom dead center.

This range of performance is employed in accordance with the control strategy under low speed and idling and low load, low speed operation. This provides good power output, smooth running and good emission control. However, as the engine moves into the medium load range condition and medium speed, the control strategy moves to the phase shown at B. This is done in order to provide a retardation of the opening of the exhaust valves and a like degree of retardation of the opening of the intake valve.

In accordance with this embodiment of the invention, this is accomplished by activating the variable valve timing mechanism associated with the exhaust camshaft 22 in this embodiment which comprises actuating the variable valve timing mechanism 27 so as to retard the timing of opening and closing of both of the exhaust valves in the same degree and in the same sense. This provides good running in these mid-range conditions.

Figure 7:
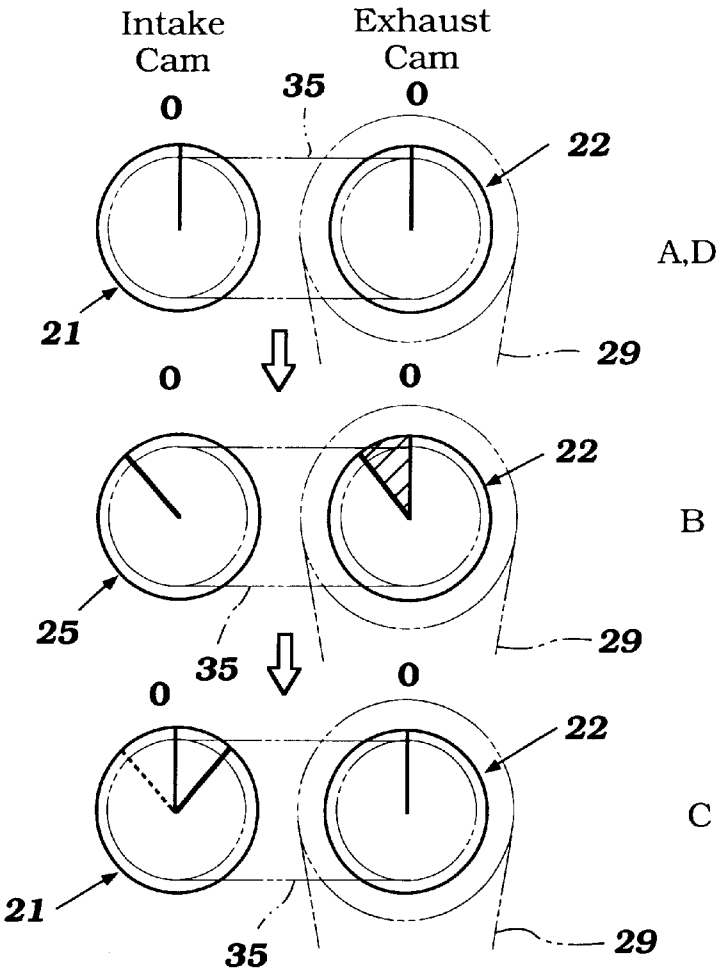
FIG. 7 is a front elevational view showing the various control phases for the embodiment of FIGS. 1–3.
Figure 8:
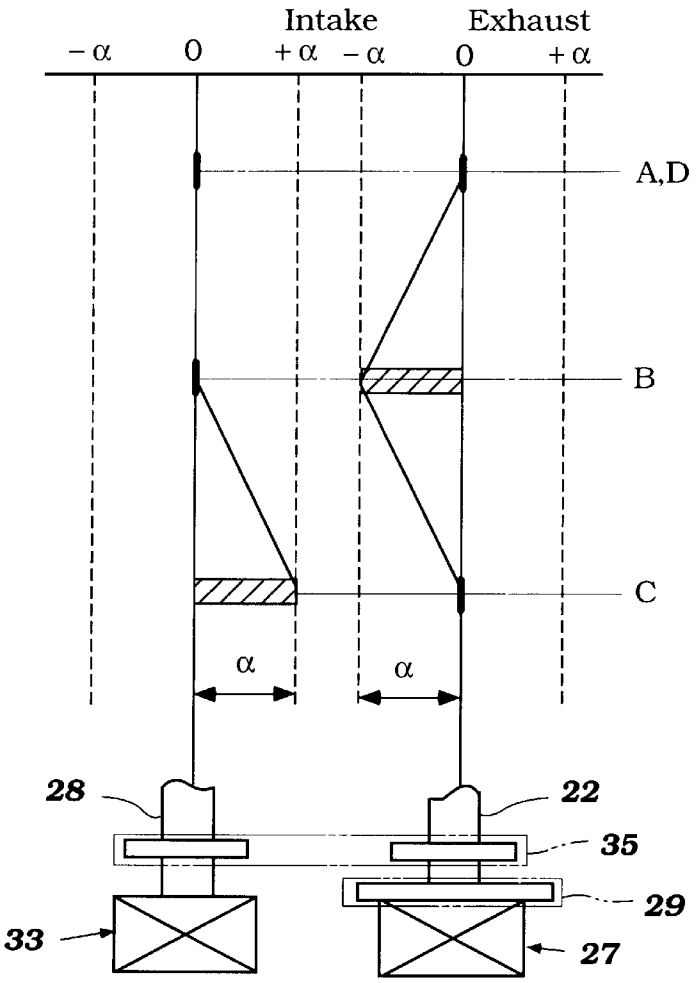
FIG. 8 is a top plan view and timing view also showing how the phase adjustments for the embodiment of FIGS. 1–3 are made.

This is accomplished by actuating only the VVT mechanism 27 that is associated with the exhaust camshaft. Since the intake camshaft is directly driven by the timing drive 35 between the two camshafts, the phase of both camshafts will be shifted simultaneously at the same rate. This condition also is shown in FIGS. 7 and 8.

However, when the engine is operating at either the low speed, high load condition, the control stage C is employed. In this condition, and as seen in FIGS. 7 and 8, the variable valve timing mechanism 27 associated with the intake exhaust camshaft 22 is not actuated, but that associated with the intake camshaft is located so as to affect an advance in the timing of the opening of the intake valves relative to the exhaust valves so as to provide more overlap and a higher power output under this condition.

Thus, it will be seen that this mechanism is operated in a way so that only one or the other of the variable valve timing mechanisms need be operated at any given time so as to provide a change in camshaft timing in order to obtain the desired engine performance. In this way, it is possible to obtain better performance and still use two variable valve timing mechanisms but a simpler control strategy when both variable valve timing mechanisms need be employed to control both camshafts under most engine operating conditions.

Figure 6:
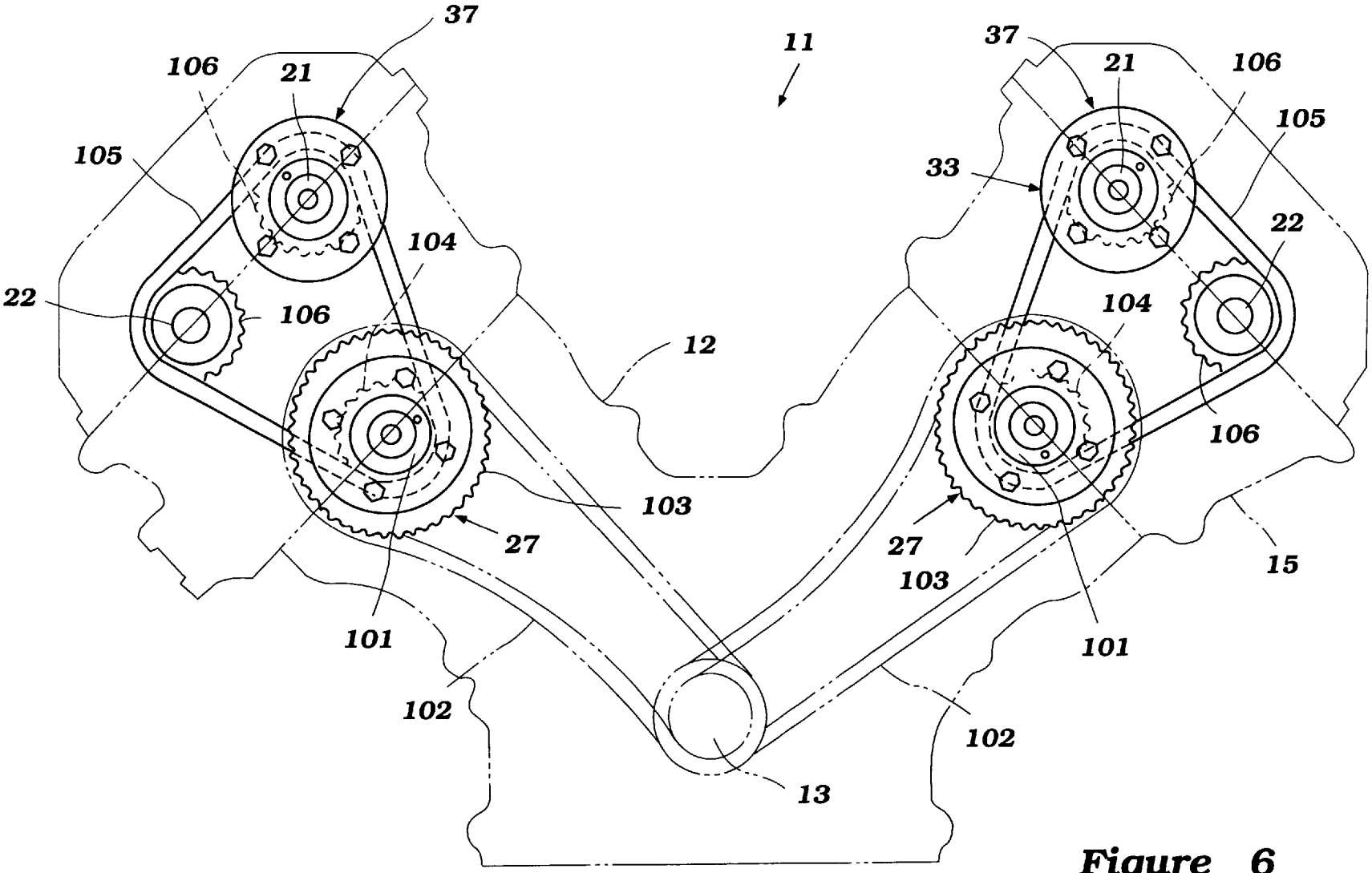
FIG. 6 is a front elevational view, in part similar to FIG. 1, but shows another embodiment of the invention.
Figure 9:
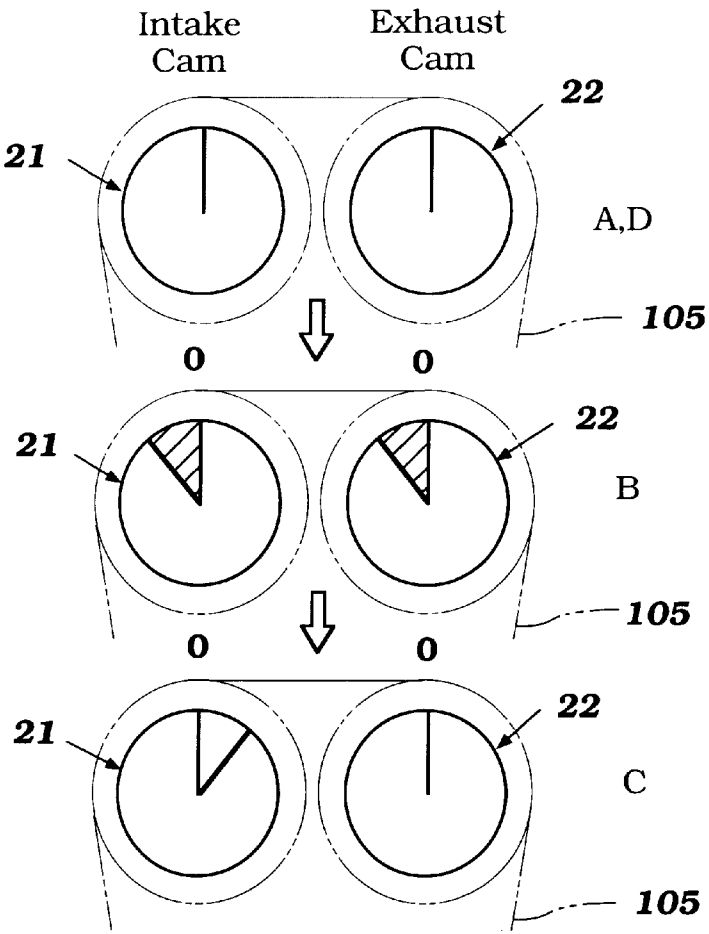
FIG. 9 is a front elevational view, in part similar to FIG. 7, but shows the same phases for the embodiment of FIG. 6.
Figure 10:
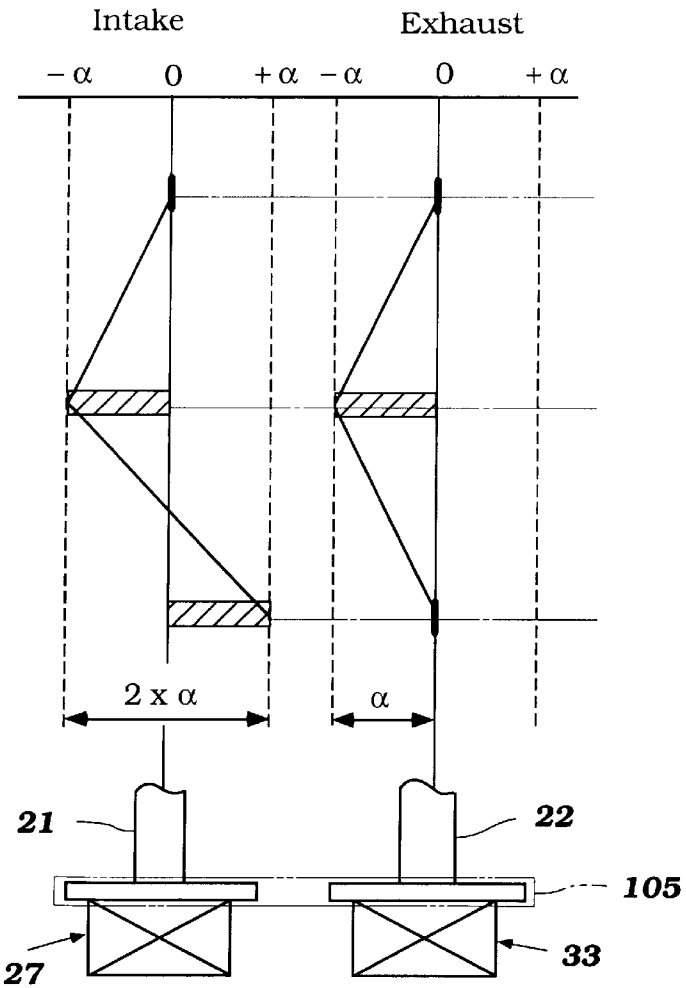
FIG. 10 is a view, in part similar to FIG. 8, but shows the relationship for the embodiment of FIG. 6.

Embodiment of FIGS. 6, 9 and 10

In the preceding embodiment, the valve driving arrangement employed a drive where one of the camshafts (the exhaust camshafts 22) was driven directly from the engine crankshaft 13 and the other camshaft (the intake camshaft 21) was driven directly by the exhaust camshaft. FIG. 6 shows another embodiment of the invention that employs a slightly different arrangement in that the variable valve timing mechanism 27 is moved from the exhaust camshaft 22 to a connection to an intermediate shaft 101 that is journaled within the engine body in a suitable manner and preferably at the interface between the cylinder block 12 and the cylinder head assembly 14.

In this embodiment, a pair of flexible transmitters 102, one for each bank, drive the intermediate shaft 101 by means of a drive to a main driving pulley 103. This driving pulley 103 is connected to an intermediate sprocket 104 through the variable valve timing mechanism 27. Thus, it is possible through adjustment of the VVT mechanism 27 to change the phase angle between the engine crankshaft 13 and both the intake and exhaust camshafts 21 and 22 which are driven from the intermediate shaft 14 in a manner which will now be described.

The intake and exhaust camshafts 22 and 23 are driven from a flexible transmitter 105 which may, in this case, be a belt and each of which is connected to a respective driving sprocket 106. The exhaust camshaft sprocket 106 is directly connected to the exhaust camshaft 22. The intake camshaft 21 is, however, driven by the sprocket 102 through a second variable valve timing mechanism 37 which has a variable valve timing connection between it and its connection to the intake camshaft 21. Thus, like the previous embodiment, it is possible to adjust the camshafts independently of each other but in a manner that does not require actuation of both camshafts at all times.

Like the previously described embodiment, this is accomplished in the same control phases indicated at A, B, C and D. Under low speed, low load conditions and high speed, high load conditions, neither of the variable valve timing mechanisms 27 or 32 is operated. Thus there is no change any of the phase angles. This is shown again in FIGS. 9 and 10.

However, when operating at the mid range, mid load, medium speed conditions, the variable valve timing mechanism 27 is actuated so as to retard the opening of both of the intake and exhaust valves by shifting their phase angle in the same direction and in the same degree as shown in FIGS. 5, 9 and 10.

However, when operating at the low speed, high load condition, the variable valve timing mechanism 27 is not actuated and only the variable valve timing mechanism 37 associated with the intake camshaft 21 is actuated so as to advance its timing of openings and thus provide greater torque and power output under this engine running condition.

Thus, it should be apparent from the foregoing description that the described embodiments of the invention provide a very effective and simple variable valve timing mechanism and control strategy whereby performance can be improved under all speed and load ranges while simplifying the variable valve timing mechanism and not employing separate ones for each camshaft directly and separate control strategies for each camshaft to achieve the desired results.

Of course, it is to be understood that the described embodiments are preferred embodiments. As mentioned earlier, it is also possible to utilize this concept with engines where there are multiple valves that perform either the intake or exhaust functions or both and that the timing of one valve, either intake or exhaust, may be adjusted relative to the timing of the other valve, either intake or exhaust or both can be controlled simultaneously and in the same direction.

Therefore, it should be readily apparent to those skilled in the art that various changes and modifications may be made without departing from the spirit and scope of the invention, as set forth in the appended claims.

What is claimed is:

1. An internal combustion engine and camshaft timing drive comprising an output shaft driven by combustion occurring in at least one combustion chamber of said engine, a first camshaft for operating at least one valve associated with said combustion chamber, a second camshaft for operating at least a second valve associated with said combustion chamber, said first and said second camshafts having juxtaposed first ends, a first timing drive for driving said first camshaft from said output shaft at said first end of said first camshaft, a second timing drive for driving said first end of said second camshaft from said first end of said first camshaft, said first and second timing drives driving said camshafts at the same speed in timed relationship from said output shaft, a first variable valve timing arrangement arranged in said first timing drive for adjusting the timing of opening of said first and said second valves by said first and said second camshafts in the same degree and in the same direction, a second variable valve timing mechanism interposed in said second timing drive for adjusting the timing of opening and closing of said second valve relative to said first valve.

2. An internal combustion engine as set forth in claim 1, wherein one of the valves comprises an intake valve and the other of the valves comprises an exhaust valve.

3. An internal combustion engine as set forth in claim 1, wherein at least one of the first timing drive and the second timing drive comprises a flexible transmitter.

4. An internal combustion engine as set forth in claim 3, wherein both of the timing drives comprise flexible transmitters.

5. An internal combustion engine as set forth in claim 4, wherein the second variable valve timing mechanism is interposed at the point where the second timing drive drives the second camshaft.

6. An internal combustion engine as set forth in claim 5, further including a control means for operating no more than one of the variable valve timing mechanisms under all running conditions of the engine so that both variable valve timing mechanisms need not be operated simultaneously under any engine running condition.

* * * * *